US007159407B2

(12) United States Patent
Chen

(10) Patent No.: US 7,159,407 B2
(45) Date of Patent: Jan. 9, 2007

(54) ATOMIZED LIQUID JET REFRIGERATION SYSTEM

(76) Inventor: Kuo-mei Chen, 10F-1, 493 Chian-Kuo 3rd Road, Kaohsiung (TW)

( * ) Notice: Subject to any disclaimer, the term of this patent is extended or adjusted under 35 U.S.C. 154(b) by 0 days.

(21) Appl. No.: 10/865,659

(22) Filed: Jun. 9, 2004

(65) Prior Publication Data

US 2005/0274130 A1 Dec. 15, 2005

(51) Int. Cl.
*F25B 19/00* (2006.01)

(52) U.S. Cl. ..... 62/100

(58) Field of Classification Search ..... 62/100, 62/115, 498, 500, 513, 434, 48.1, 57; 165/104.17
See application file for complete search history.

(56) References Cited

U.S. PATENT DOCUMENTS

| | | | | |
|---|---|---|---|---|
| 1,619,194 | A | 3/1927 | Davenport | |
| 1,619,196 | A | 3/1927 | Davenport | |
| 1,845,356 | A | 2/1932 | Sorensen | |
| 1,882,257 | A | 10/1932 | Randel | |
| 1,892,741 | A | 1/1933 | Sorensen | |
| 2,158,741 | A * | 5/1939 | Christman | 237/12.3 A |
| 2,159,251 | A | 5/1939 | Brizzolara | |
| 2,386,554 | A | 10/1945 | Holicer | |
| 3,844,132 | A * | 10/1974 | Miller et al. | 62/268 |
| 3,909,957 | A * | 10/1975 | Passey | 34/92 |
| 4,221,240 | A * | 9/1980 | Alexander, Sr. | 139/1 R |
| 4,237,695 | A * | 12/1980 | Oberpriller et al. | 62/63 |
| 4,608,119 | A * | 8/1986 | Rowland | 159/3 |
| 4,821,794 | A * | 4/1989 | Tsai et al. | 165/104.17 |
| 4,866,947 | A | 9/1989 | Webster | |
| 5,046,321 | A | 9/1991 | Webster | |
| 5,122,053 | A * | 6/1992 | Basten | 431/12 |
| 5,195,509 | A * | 3/1993 | Rentschler et al. | 601/4 |
| 5,444,986 | A * | 8/1995 | Hino | 62/66 |
| 5,500,238 | A * | 3/1996 | Thienpont | 426/511 |
| 5,788,667 | A * | 8/1998 | Stoller | 604/22 |
| 6,017,439 | A * | 1/2000 | Gannon | 205/703 |
| 6,180,843 | B1 * | 1/2001 | Heinemann et al. | 585/15 |
| 6,410,284 | B1 * | 6/2002 | Aksenov et al. | 435/173.1 |
| 6,518,349 | B1 * | 2/2003 | Felix et al. | 524/492 |
| 6,579,706 | B1 * | 6/2003 | Grae | 435/173.5 |
| 6,601,776 | B1 | 8/2003 | Oljaca et al. | |
| 6,672,091 | B1 | 1/2004 | Lefor et al. | |
| 6,793,007 | B1 * | 9/2004 | Kramer et al. | 165/80.4 |
| 2002/0146373 | A1 * | 10/2002 | Edwards et al. | 424/46 |

FOREIGN PATENT DOCUMENTS

JP 3-143502 A * 6/1991

(Continued)

OTHER PUBLICATIONS

"Additional jet vacuum cooling saves Pfizer $100,000", Petrochemical Processing, Croll-ReynoldsCo., Inc. paper, 2 pages.

(Continued)

*Primary Examiner*—Mohammad M. Ali
(74) *Attorney, Agent, or Firm*—Patent Law Group LLP; David C. Hsia

(57) ABSTRACT

A system for controlling temperature includes an atomizer that forms micron-sized hydrogen-bonded refrigerant droplets within a chamber. A vacuum pump is coupled to the chamber to lower its interior pressure. Under these conditions, the refrigerant droplets evaporate while lowering the temperature of its immediate surrounding. In one embodiment, the atomizer includes a pump that forces a hydrogen-bonded liquid refrigerant through a nozzle.

30 Claims, 4 Drawing Sheets

FOREIGN PATENT DOCUMENTS

| | | | |
|---|---|---|---|
| JP | 5-214412 A | * | 8/1993 |
| JP | 11-280650 A | * | 10/1999 |

OTHER PUBLICATIONS

"When properly maintained, steam jet vacuum chillers can cut steam use in half for mill refrigeration applications, as it did at Weyerhaeuser's Flint River mill Less Environmental Impact/Steam Use Characterize Vacuum Chiller OPeration," downloaded from http://www.paperloop.com on May 24, 2004, pp. 1-7.

"Steam Jet Chiller Principle," Artisan Industries Inc., paper downloaded from http://www.artisanind.com/jetvac/chillerpoo.htm on May 24, 2004, 1 page.

A.D. Althouse et al., "Modern Refrigeration and Air Conditioning," The Goodheart-Wilcox Co., South Holland, IL., 1988, p. 295.

A.H. Lefebvre, "Fuel Atomization, Droplet Evaporatin, and Spray Combustion," in Fossill Fuel Combustion, edited by W. Bartok and A.F. Sarofim, John Wiley & Sons, New York, 1991, pp. 529-652.

S.P. Lin et al., "Drop and Spray Formation from a Liquid Jet," Annu. Rev. Fluid Mech. 30 (1998), pp. 85-105.

R.D. Reitz et al., "Mechanism of atomization of a liquid jet," Phys. Fluids 25, (1982), pp. 1730-1742.

P. W. Atkins, "The electric and magnetic properties of molecules," Physical Chemistry, fifth edition, Oxford University Press, 1994, pp. 770-771.

* cited by examiner

ATOMIZED LIQUID JET REFRIGERATION SYSTEM

FIELD OF INVENTION

This invention relates to refrigeration systems.

DESCRIPTION OF RELATED ART

Conventional refrigeration systems employ the compression technology of chlorofluorocarbon (CFC), hydrofluorocarbon (HFC), hydrochlorofluorocarbon (HCFC), and ammonia ($NH_3$) refrigerants. Gaseous refrigerants are compressed to the liquid state through heat exchanges with the environment. Evaporations of liquefied CFC or $NH_3$ refrigerants provide the cooling mechanism. Because the heat of vaporization of $NH_3$ is larger than those of CFCs, and that $NH_3$ is easily compressible to a condensed phase, $NH_3$ compression refrigeration systems are widely utilized in various manufacturing industries and in large storage facilities. On the other hand, the corrosive characteristics of $NH_3$ require that special operational precautions to be imposed. Thus, domestic refrigerators and air-conditioners (including motor vehicle ACs) invariably utilize the compression technology of CFC refrigerants. The formidable issues of ozone depletion and the greenhouse effect caused by CFC and HCFC refrigerants demand a new refrigeration technology.

In the prior art, water is not used as the refrigerant for a compression cycle refrigerating system. A. D. Althouse, C. H. Turnquist, A. F. Bracciano, "Modern Refrigeration and Air Conditioning," The Goodheart-Willcox Co., South Holland, Ill., 1988, p. 295. However, water is the refrigerant for steam jet refrigeration used in connection with air conditioning systems. Id. A steam jet refrigeration chiller employs the momentum of steam to pump away gaseous water molecules. Thus, evaporation of water in the chill tank under reduced pressure cools down the water reservoir in the chill tank. This is an inefficient method that relies on an inexpensive supply of high pressure steam and can only cool the water reservoir to about 4° C.

In the prior art, such as U.S. Pat. Nos. 2,159,251, 2,386,554, 4,866,947, 5,046,321, and 6,672,091, atomizers have been used instead of the expansion valve in conventional compression cycle refrigerating systems to improve the evaporation rate of the refrigerant.

Thus, what is needed is a refrigeration system that (1) employs a refrigerant that is environmental-friendly, chemically non-corrosive, non-flammable, and physiologically harmless, and (2) provides the same or better performance while consuming the same or less energy as conventional technologies.

BRIEF DESCRIPTION OF THE DRAWINGS

Use of the same reference numbers in different figures indicates similar or identical elements.

SUMMARY

Figure 1:
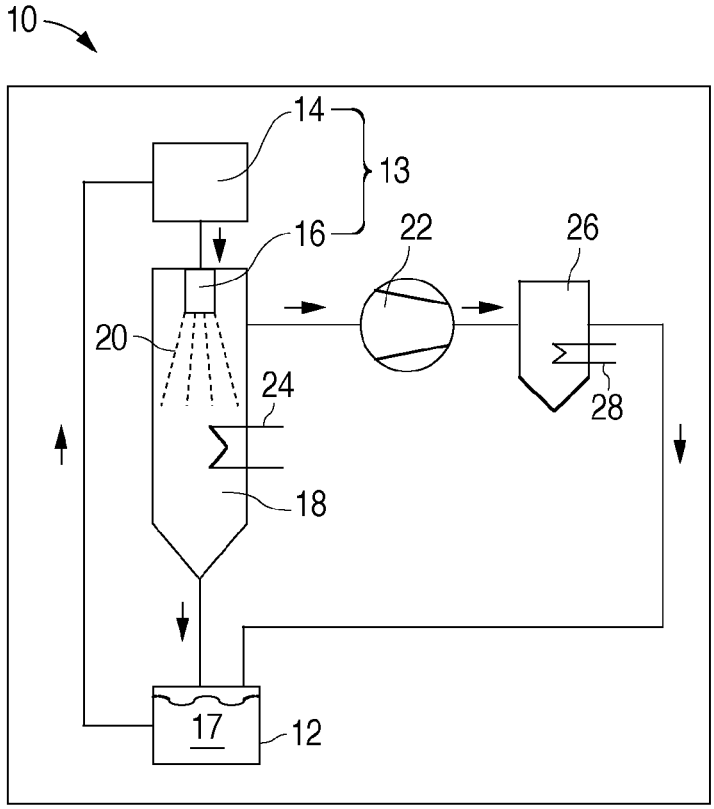
FIG. 1 is a block diagram of a refrigeration system in one embodiment of the invention.

In one embodiment of the invention, a system for controlling temperature includes an atomizer that forms micron-sized hydrogen-bonded refrigerant droplets within a chamber. A vacuum pump is coupled to the chamber to lower its interior pressure. Under these conditions, the refrigerant droplets evaporate while lowering the temperature of its immediate surrounding. In one embodiment, the atomizer includes a pump that forces a hydrogen-bonded liquid refrigerant through a nozzle.

In one embodiment, a method for controlling temperature includes lowering the pressure within a chamber and generating micron-sized hydrogen-bonded refrigerant droplets within the chamber. Under these conditions, the refrigerant droplets evaporate while lowering the temperature of its immediate surrounding. In one embodiment, the refrigerant droplets are generated by pumping a hydrogen-bonded liquid refrigerant through a nozzle.

DETAILED DESCRIPTION

A liquid jet refrigeration system utilizes the atomization of hydrogen-bonded liquid refrigerants to meet environmental needs, occupational safety standards, and fast cooling rates. The evaporation efficiencies of environmental-friendly hydrogen-bonded liquid refrigerants are greatly enhanced by atomizing them into streams of micron-sized refrigerant droplets. In addition to the advantage of the large heats of vaporization of hydrogen-bonded liquid refrigerants, these gaseous refrigerants are easily condensed under compression. Energy consumptions of the liquid jet refrigeration system are more efficient in comparison with those of conventional technologies.

After 1950, refrigerants that are liquids at room temperatures (25° C.) and 1 atmosphere have never been considered for refrigeration systems using compression technologies. However, there are many hydrogen-bonded liquids that are environmental-friendly, chemically non-corrosive, non-flammable, and physiologically harmless (e.g., alcohol/water mixtures, such as ethyl alcohol ($C_2H_5OH$)). Above all, they exhibit heats of vaporization larger than those of $NH_3$ ($\Delta H_0^{vap}$=40.6 kJ/mole, 43.5 kJ/mole, and 23.35 kJ/mole for water, ethyl alcohol, and ammonia, respectively).

According to their phase diagrams and thermodynamic properties, these liquid refrigerants evaporate spontaneously under reduced pressure. Meanwhile, the evaporated molecules that escape from the surface carry away the internal energy of the liquid (heats of vaporization). Thus, the evaporation of the liquefied refrigerant, e.g., at 25° C. initially, cools the remaining liquid into a state of lower temperature under reduced pressure. This refrigeration mechanism can be maintained in principle as long as a good vacuum environment (better than $10^{-2}$ mbar) is created above the liquid surface.

In practice, the rate of evaporation is not controlled thermodynamically but kinetically. According to the kinetic theory of gases, the rate of evaporation dN/dt is given by:

$$\frac{dN}{dt} = -\frac{\Delta P N_A A}{(2\pi MRT)^{1/2}}, \quad (1)$$

where ΔP is the pressure difference between the equilibrium vapor pressure of the liquid at temperature T and the gaseous pressure of the environment, $N_A$ is the Avogadro number, M is the molecular weight, R is the gas constant, and A is the surface area of the liquid phase. When a 1 $cm^3$ liquid droplet is dispersed into 1 μm micro-spheres, the surface area is increased by four orders of magnitude ($10^4$). Consequently, the rate of cooling is substantially enhanced by atomizing the liquid into micron-sized droplets (i.e., dispersing a liquid into mist).

There are many techniques to atomize liquids into micron-sized droplets, including (1). liquid jet atomization by pumping a liquid through micron-sized pinholes, (2) ultrasonic atomization, (3) piezoelectric atomization, and (4) DC-discharge atomization. Presently, experiments demonstrate that liquid jet atomization serves the refrigeration purpose quite well. For example, a refrigeration chamber can be cooled from 21° C. to −20° C. around 6 minutes. The cooling mechanism is provided by the evaporation of micron-sized refrigerant droplets under reduced pressure. The micron-sized refrigerant droplets are created by pumping the liquid refrigerant through a nozzle having an array of micron-sized pinholes.

FIG. 1 illustrates a refrigeration system 10 in one embodiment of the invention. System 10 includes a liquid refrigerant reservoir 12 that stores a liquid refrigerant 17. Liquid refrigerant 17 is preferably in a liquid state at 25° C. and 1 atmosphere. Liquid refrigerant 17 is preferably a hydrogen-bonded liquid such as water, alcohol (e.g., ethanol or methanol), an alcohol/water mixture (e.g., a 70:30 mixture of ethanol and water), or diethyl ether. In one embodiment, pure water refrigerant is used.

From liquid refrigerant 17 in reservoir 12, an atomizer 13 generates micron-sized refrigerant droplets 20. In one embodiment, atomizer 13 includes a liquid pump 14 and a nozzle 16. Liquid pump 14 forces liquid refrigerant 17 through nozzle 16 to inject micron-sized refrigerant droplets 20 into a low-pressure chamber 18 (e.g., a heat exchanger). In one embodiment, liquid pump 14 (e.g., a NP-CX-100 from Nihon Seimitsu Kagaku of Tokyo, Japan) delivers a flow rate of 80 ml/min at a pressure of 30 bar.

Figure 2:
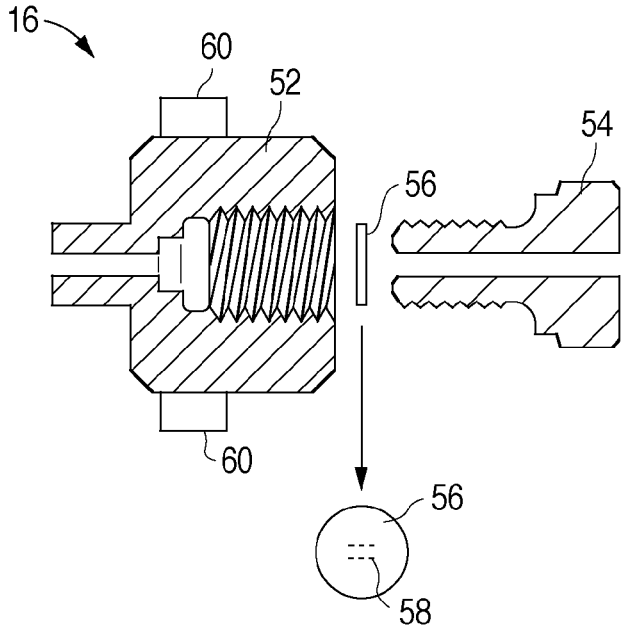
FIG. 2 is a schematic of a nozzle used to generate jets of micron-sized refrigerant droplets in one embodiment of the invention.

FIG. 2 illustrates the details of nozzle 16. Nozzle 16 includes a vacuum female fitting 52 and a vacuum male fitting 54 (e.g., VCR® fittings made by Cajon Company of Macedonia, Ohio). A nozzle plate 56 is inserted into vacuum female fitting 52 and secured by vacuum male fitting 54. Nozzle plate 56 has micron-sized pinholes 58 (only one is labeled) that disperse liquid refrigerant 17 as jets of micron-sized refrigerant droplets 20 having a diameter of less than 50 μm.

In one embodiment, pinholes 58 have a diameter of 80 μm and generate refrigerant droplets 20 having a diameter of approximately 10 μm. In this embodiment, nozzle plate 56 is a stainless steel plate having a diameter of 13 mm and a thickness of 1 mm. In this embodiment, six or more pinholes 58 are laser-drilled into nozzle plate 56 (e.g., by a COMPEX 200 and SCANMATE 2E laser system made by Lambda Physik of Göttingen, Germany).

Nozzle 16 may include a heater 60 (e.g., an electric heater or a water heater that circulates room temperature water around the nozzle) to prevent liquid refrigerant 17 from clogging nozzle 16 when it freezes. Parameters such as the flow rate, the applied pressure, the number of pinholes in the nozzle array, and the pinhole size may be modified to generate the micron-sized refrigerant droplets of the appropriate size.

Referring back to FIG. 1, a vacuum pump/compressor 22 reduces the pressure within heat exchanger 18 so that refrigerant droplets 20 evaporate when introduced into heat exchanger 18 and absorb heat from the remaining refrigerant droplets and its immediate surroundings. Vacuum pump/compressor 22 can be a mechanical pump or a Roots pump with a backup mechanical vacuum pump (e.g., a RSV 1508 Roots pump made by Alcatel of Annecy Cedex, France, and an SD-450 vacuum pump made by Varian of Lexington, Mass.). The large surface area of the atomized droplets greatly enhances their evaporate rate. In one embodiment, the pressure within heat exchanger 18 is reduced to $10^{-2}$ mbar. Heat exchanger 18 may include a conduit 24 that carries a medium (e.g., ambient air) that is cooled as the medium travels into and out of heat exchanger 18. Alternatively, the medium can simply be blown over the outer surface of heat exchanger 18.

Figure 3:
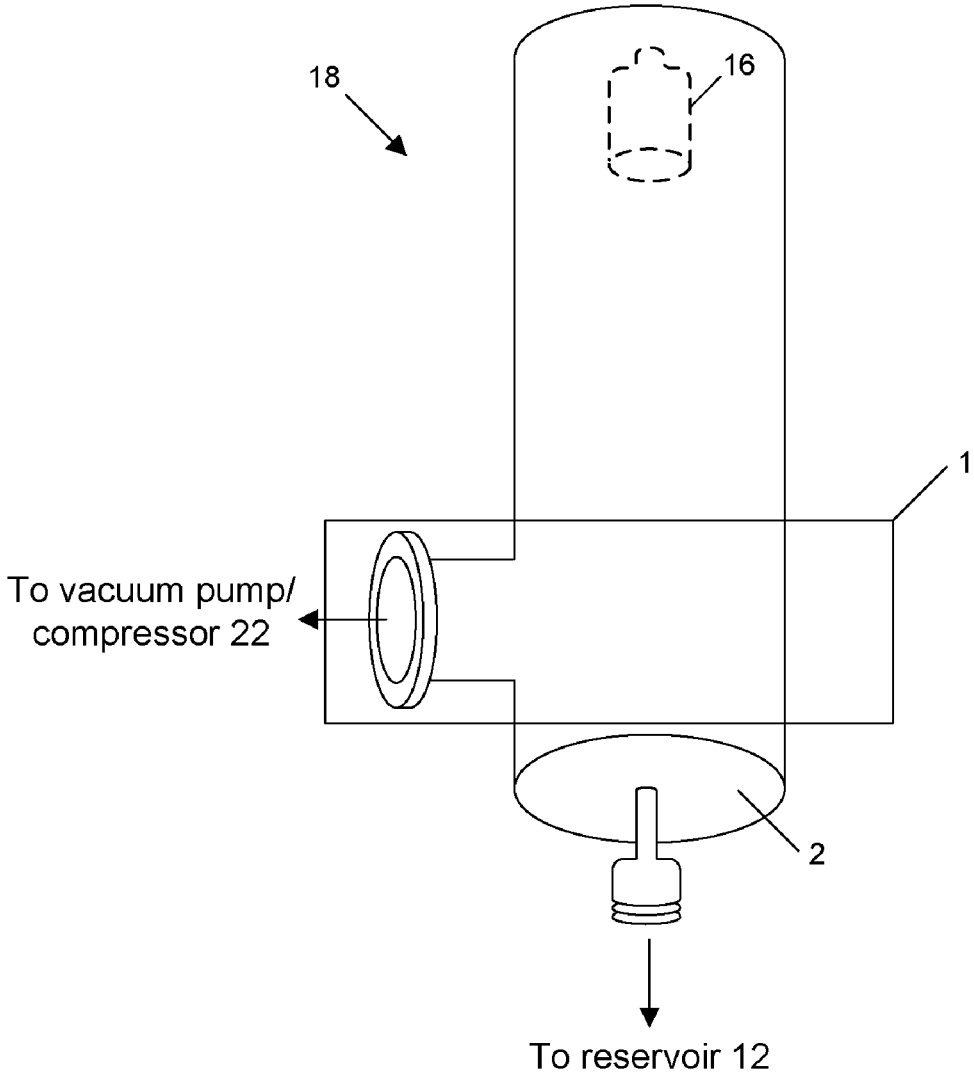
FIG. 3 is a schematic of a low-pressure heat exchanger for transferring heat away from ambient air to refrigerant droplets in one embodiment of the invention.

FIG. 3 illustrates heat exchanger 18 in one embodiment of the invention. Heat exchanger 18 has an outlet to vacuum pump/compressor 22 located on an opposite end away from nozzle 16. Heat exchanger 18 can be made of any conventional form, e.g., coil or fin types. The medium that is cooled can be any gaseous or liquefied heat transfer materials. In one embodiment, the medium is used to cool a space such as a room or a refrigeration compartment. Any refrigerant droplets 20 that do not evaporate are collected at the bottom of heat exchanger 18 and returned to reservoir 12.

In one embodiment, system 10 is an open loop refrigeration system because liquid refrigerant 17, like water, can be safely expelled into the environment. In this embodiment, vacuum pump/compressor 22 simply expels the gaseous refrigerant into the atmosphere. In this embodiment, reservoir 12 can be replaced by a water supply line (e.g., a city supplied water line to a home or a business).

In one embodiment, system 10 is a closed cycle refrigeration system because liquid refrigerant 17 cannot be safely expelled into the environment. In this embodiment, vacuum pump/compressor 22 compresses the gaseous refrigerant into an atmospheric pressure chamber 26 (e.g., another heat exchanger).

Referring back to FIG. 1, heat changer 26 may include a conduit 28 that carries another medium (e.g., ambient air) that condenses the gaseous refrigerants as the medium travels into and out of heat exchanger 26. Alternatively, the medium can simply be blown over the outer surface of heat exchanger 26. As the gaseous refrigerant condenses, it heats the medium. The heated medium can be any gaseous or liquefied heat transfer materials. In one embodiment, the heated medium is expelled to the environment. In one embodiment, the heated medium is used to heat a space such as a room or a heating compartment. The cooled liquid refrigerant 17 then exits heat exchanger 26 and returns to reservoir 12.

Figure 4:
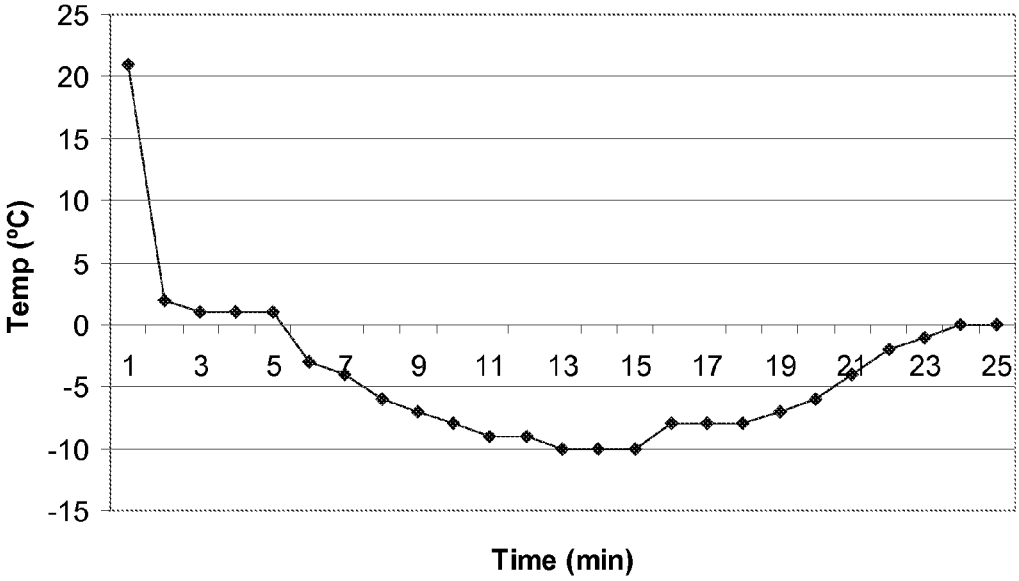
FIGS. 4 and 5 are charts illustrating the result of an open loop water refrigeration system in one embodiment of the invention.
Figure 5:
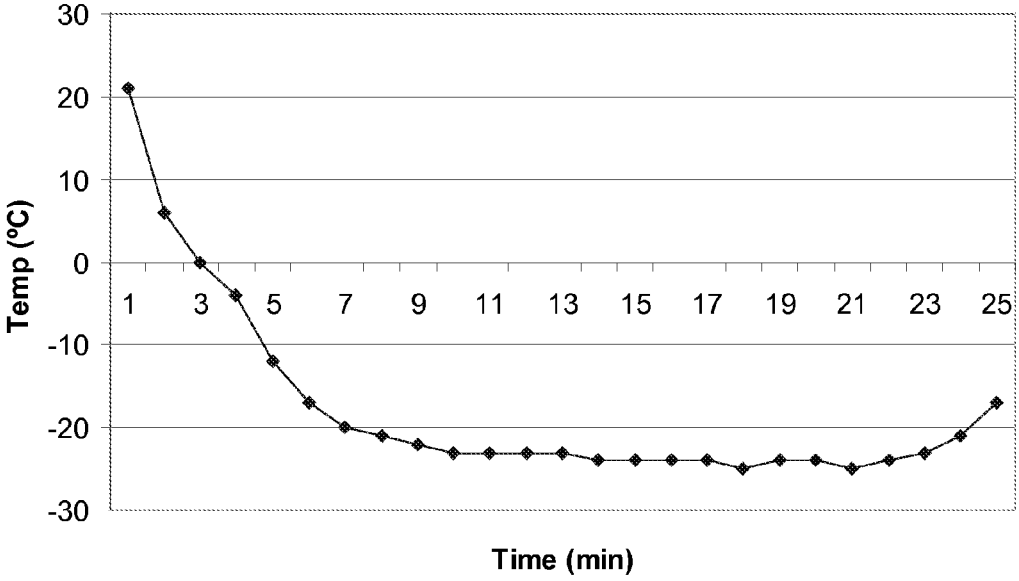

FIGS. 4 and 5 show the experimental results of one embodiment of an open loop refrigeration system 10 using a pure water refrigerant, a 6-pinhole nozzle 16, and a flow rate of 80 ml/minute. Specifically, FIG. 4 shows the temperature recorded at location 1 (FIG. 3) around heat exchanger 18, and FIG. 5 shows the temperatures recorded at location 2 (FIG. 3) at the bottom of heat exchanger 18. As can be seen in FIGS. 4 and 5, the temperature began to rise at the end of the experiment. This is because the water refrigerant started to clog nozzle 16 when it froze because nozzle 16 was not heated in the experiment. The results show that temperatures as low as −25° C. can be achieved, which is unexpected for a water refrigeration system and not disclosed by any known prior art.

Figure 6:
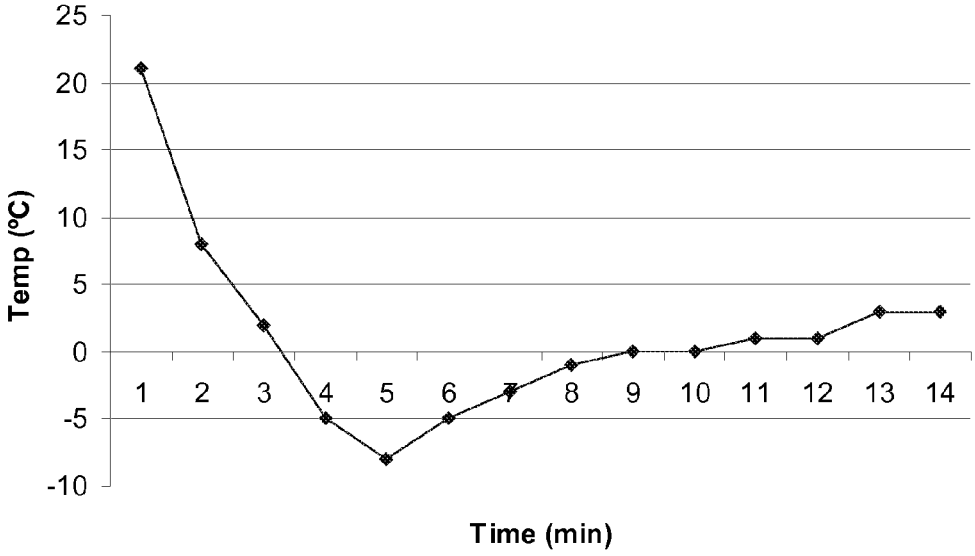
FIGS. 6 and 7 are charts illustrating the result of an open loop alcohol refrigeration system in one embodiment of the invention.
Figure 7:
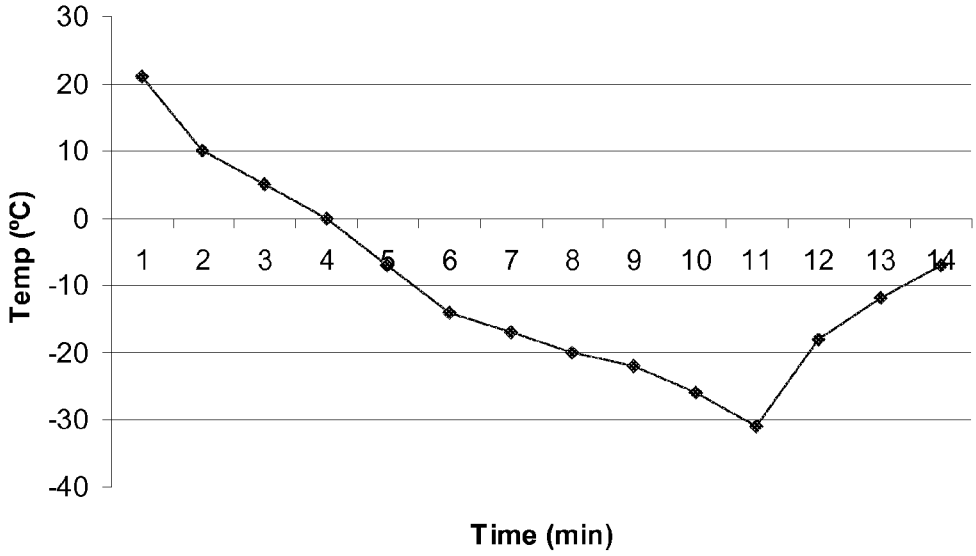

FIGS. 6 and 7 show the experimental results of one embodiment of an open loop refrigeration system 10 using an ethanol refrigerant (99.5%), a 6-pinhole nozzle 16, and a flow rate of 80 ml/minute. Specifically, FIG. 6 shows the temperature recorded at location 1 (FIG. 3) around heat exchanger 18, and FIG. 7 shows the temperatures recorded at location 2 (FIG. 3) at the bottom of heat exchanger 18. Again as can be seen in FIGS. 6 and 7, the temperature began to rise at the end of the experiment. This is because the ethanol refrigerant started to clog nozzle 16 when it froze because nozzle 16 was not heated in the experiment.

For a fast cooling rate and an ultimate low temperature, methanol/water or ethanol/water refrigerant may be used in system 10. For an environmentally friendly, chemically non-corrosive, non-flammable, and physiologically harmless refrigerant, pure water or ethanol/water refrigerant may be used in system 10. Thus, water systems can find their roles in the market of domestic appliances, while pure ethanol, ethanol/water, and methanol/water refrigeration systems can be employed in manufacturing industries and in large storage facilities.

Various other adaptations and combinations of features of the embodiments disclosed are within the scope of the invention. For example, hydrogen-bonded liquid refrigerants are not limited to the specific chemical compounds mentioned above. The material, the fabrication method, and the characteristics of the nozzle are not limited to those mentioned above. Liquid atomization by other well-known techniques, such as ultrasonic, piezoelectric, and electric discharge methods, can be used in place of the pump and the nozzle. Numerous embodiments are encompassed by the following claims.

What is claimed is:

1. A compression cycle refrigeration system for controlling temperature, comprising:

a chamber;

a vacuum pump coupled to the chamber, the vacuum pump lowering pressure within the chamber;

a supply of a liquid hydrogen-bonded refrigerant;

an atomizer coupled between the supply and the chamber, the atomizer outputting micron-sized refrigerant droplets into the chamber, wherein the refrigerant droplets evaporate to form a gaseous refrigerant by absorbing heat from its surrounding; and another chamber coupled between the vacuum pump and the supply, said another chamber being a heat exchanger including a conduit carrying a medium into and out from the heat exchanger to absorb heat from the gaseous refrigerant;

wherein the medium is an ambient air, the vacuum pump compresses the gaseous refrigerant into said another chamber, and the gaseous refrigerant condenses inside said another chamber to form the liquid hydrogen-bonded refrigerant by loosing heat to its surrounding and is returned to the supply.

2. The system of claim 1, wherein the pressure within the chamber is reduced to $10^{-2}$ mbar or less.

3. The system of claim 1, wherein the refrigerant droplets have diameters of about 10 microns.

4. The system of claim 1, wherein the refrigerant droplets have diameters of 50 microns or less.

5. The system of claim 4, wherein the atomizer is selected from the group consisting of an ultrasonic atomizer, a piezoelectric atomizer, and an electric discharge atomizer.

6. The system of claim 4, wherein the atomizer includes:

a nozzle; and a pump coupled between the supply and the nozzle, wherein the pump forces the liquid hydrogen-bonded refrigerant through the nozzle to form the micron-sized refrigerant droplets.

7. The system of claim 6, wherein the nozzle comprises pinholes.

8. The system of claim 7, wherein the pinholes have a diameter of 20 microns or less.

9. The system of claim 6, wherein the nozzle further comprises a heater to heat the nozzle.

10. The system of claim 1, wherein the liquid hydrogen-bonded refrigerant is in its liquid state at 25° C. and 1 atmosphere, and the chamber is cooled to −20°C. or less.

11. The system of claim 1, wherein the liquid hydrogen-bonded refrigerant is water.

12. The system of claim 1, wherein the hydrogen-bonded refrigerant is selected from the group consisting of alcohol and alcohol/water mixture.

13. The system of claim 12, wherein the alcohol/water mixture comprises a 70:30 mixture of ethyl alcohol and water.

14. The system of claim 1, wherein the chamber is another heat exchanger including another conduit carrying another medium into and out from said another heat exchanger to cool said another medium, and said another medium is transported away to cool a space.

15. The system of claim 1, wherein another medium is moved over the outer surface of the chamber to cool said another medium, and said another medium is transported away to cool a space.

16. The system of claim 1, wherein the supply is further coupled to the chamber to the chamber to collect any refrigerant droplets that do not evaporate.

17. A method for a compression cycle refrigeration system for controlling temperature, comprising:

reducing pressure within a chamber with a vacuum pump;

atomizing a liquid hydrogen-bonded refrigerant to form micron-sized hydrogen-bonded refrigerant droplets within the chamber, wherein the refrigerant droplets evaporate to form a gaseous refrigerant by absorbing heat from its surrounding;

compressing the gaseous refrigerant into another chamber;

condensing the gaseous refrigerant in said another chamber to form the liquid hydrogen-bonded refrigerant, wherein said condensing the gaseous refrigerant comprises passing a medium into and out of said another chamber through a conduit to heat the medium and the medium is an ambient air; and returning the liquid hydrogen-bonded refrigerant for use in said atomizing.

18. The method of claim 17, wherein the pressure within the chamber is reduced to $10^{-2}$ mbar or less.

19. The methods of claim 17, wherein the refrigerant droplets have diameters of about 10 microns.

20. The method of claim 17, wherein the refrigerant droplets have diameters of 50 microns or less.

21. The method of claim 20, wherein said atomizing comprises a method selected from the group consisting of an ultrasonic atomizing method, a piezoelectric atomizing method, and an electric discharge atomizing method.

22. The method of claim 20, wherein said atomizing comprises pumping the liquid hydrogen-bonded refrigerant through a nozzle.

23. The method of claim 22, wherein the nozzle comprises pinholes, the pinholes comprising a diameter of 20 microns or less.

24. The method of claim 23, further comprising heating the nozzle.

25. The method of claim 17, wherein the liquid hydrogen-bonded refrigerant is in its liquid state at 25° C. and 1 atmosphere, and the chamber is cooled to −20° C. or less.

26. The method of claim 17, wherein the liquid hydrogen-bonded refrigerant is water.

27. The method of claim 17, wherein the liquid hydrogen-bonded refrigerant is selected from the group consisting of alcohol and alcohol/water mixture.

28. The method of claim 27, wherein the alcohol/water mixture comprises a 70:30 mixture of ethyl alcohol and water.

29. The method of claim 17, futher comprising passing another medium into and out of the chamber to cool said another medium and said another medium is transported away to cool a space.

30. The method of claim 17, further comprising passed another medium over the chamber to cool said another medium is transported away to cool a space.

* * * * *